United States Patent [19]

Perschka et al.

[11] Patent Number: 4,564,998

[45] Date of Patent: Jan. 21, 1986

[54] COIL WINDING METHODS AND APPARATUS

[75] Inventors: Dale O. Perschka, Nicholson, Ga.; Stuart L. Rieben, Mt. Lebanon Township, Allegheny County, Pa.

[73] Assignee: Westinghouse Electric Corp., Pittsburgh, Pa.

[21] Appl. No.: 662,653

[22] Filed: Oct. 19, 1984

[51] Int. Cl.[4] ..... H01F 41/12

[52] U.S. Cl. ..... 29/605; 29/33 F; 29/738; 242/4 R

[58] Field of Search ..... 29/33 L, 33 F, 564.5, 29/564.7, 33 E, 605, 738, 761; 242/4 R, 4 A, 4 C

[56] References Cited

U.S. PATENT DOCUMENTS

| | | | |
|---|---|---|---|
| 3,128,955 | 4/1964 | Stütz | 242/4 R |
| 3,566,462 | 3/1971 | Moore | 29/605 |
| 4,269,366 | 5/1981 | Lindenmeyer | 242/4 R |
| 4,381,600 | 5/1983 | Mas | 29/738 |

FOREIGN PATENT DOCUMENTS

| | | | |
|---|---|---|---|
| 2163701 | 6/1973 | Fed. Rep. of Germany | 29/605 |
| 67510 | 6/1969 | German Democratic Rep. | 242/4 R |
| 222840 | 11/1942 | Switzerland | 242/4 R |
| 543004 | 2/1942 | United Kingdom | 242/4 R |
| 1019034 | 2/1966 | United Kingdom | 242/4 R |

*Primary Examiner*—William R. Briggs
*Attorney, Agent, or Firm*—D. R. Lackey

[57] ABSTRACT

Method and apparatus for winding an electrical conductor about the leg of a magnetic core. A single set of drive rolls and a single set of ironing rolls cooperatively tightly wrap the conductor about the leg of the magnetic core.

8 Claims, 12 Drawing Figures

COIL WINDING METHODS AND APPARATUS

BACKGROUND OF THE INVENTION

1. Field of the Invention

The invention relates in general to coil winding method and apparatus, and more specifically to coil winding method and apparatus suitable for winding an electrical conductor directly about the leg of a magnetic core.

2. Description of the Prior Art

Copending Application Ser. No. 527,601 filed Aug. 29, 1983, U.S. Pat. No. 4,529,138, which is assigned to the same assignee as the present application, discloses new and improved apparatus and methods for winding an electrical conductor directly upon the leg of a magnetic core. Thus, the magnetic core may be a wound, uncut core. While the methods and apparatus disclosed in this copending application provide acceptable results, it would be desirable to simplify the methods and apparatus, if possible to do so without incurring offsetting disadvantages.

SUMMARY OF THE INVENTION

Briefly, the present invention cooperatively combines the functions of a single set of drive rolls and a single set of ironing rolls ro wind an electrical conductor directly upon the leg of a magnetic core. The disclosed arrangement eliminates one set of drive rolls and set of wrapping rolls which grasp the conductor, from the prior art arrangement of the copending patent application, substantially reducing the complexity and therefore the cost of the apparatus, while improving the winding method. The present application also discloses an adjustable guide loop, preferably formed of a non-metallic low friction sheet material, such as nylon, which accommodates different original lengths of conductor, it accommodates the changing conductor length as the coil is being wound, and it directs the lead end of the conductor back to the entrance side of the core window, for starting the next conductor turn.

BRIEF DESCRIPTION OF THE DRAWING

The invention may be better understood, and further advantages and uses thereof more readily apparent, when considered in view of the following description of exemplary embodiments, taken with the accompanying drawings in which.

DESCRIPTION OF THE PREFERRED EMBODIMENTS

Figure 1:
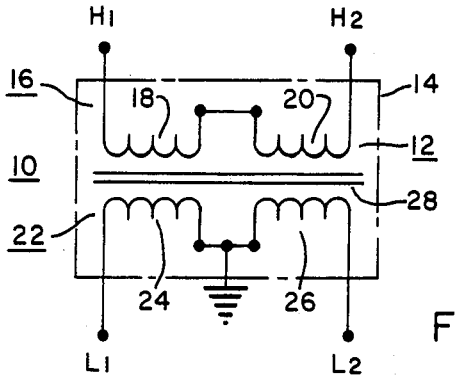
FIG. 1 is a schematic diagram of a typical distribution type transformer having an exemplary winding arrangement which may be constructed according to the teachings of the invention.

Referring now to the drawings, and to FIGS. 1 through 4 in particular, there is shown in FIG. 1 a schematic diagram of a typical electrical transformer 10 of the distribution type, which may be constructed according to the teachings of the invention. Transformer 10 includes a core-coil assembly 12 disposed in a tank 14, which may contain a liquid insulating dielectric and coolant, such as mineral oil. Core-coil assembly 12 includes a primary or high voltage winding 16, which may be formed of electrically connected sections or part windings 18 or 20, and a secondary or low voltage winding 22, which also may be formed of electrically connected winding sections, such as winding sections 24 and 26. High and low voltage windings 16 and 22, respectively, are disposed in inductive relation with a magnetic core 28. High voltage bushings or terminals H1 and H2 are connected to the ends of the high voltage 16, and low voltage bushings or terminals L1 and L2 are connected to the ends of the low voltage winding 22.

Figure 3:
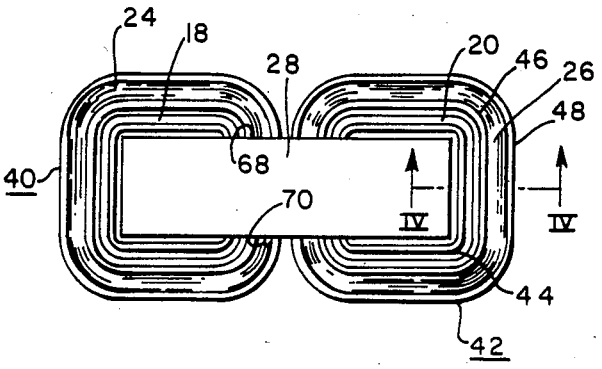
FIG. 3 is a plan view of the core-coil assembly shown in FIG. 2.
Figure 2:
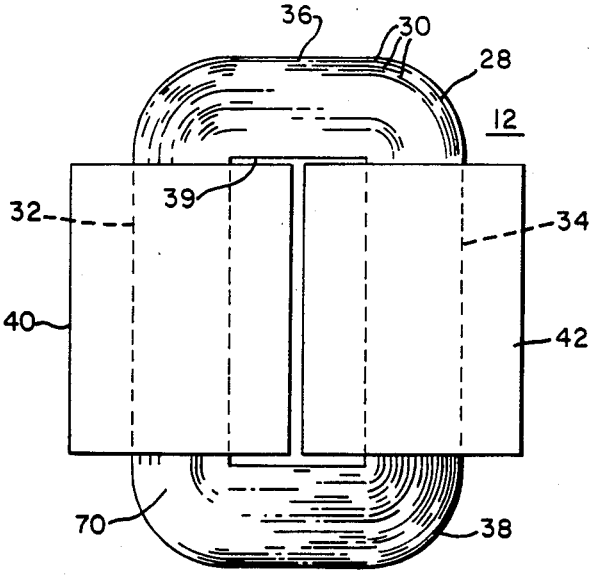
FIG. 2 is an elevational view of a core-coil assembly for the electrical transformer shown in FIG. 1, which may be constructed according to the teachings of the invention.
Figure 4:
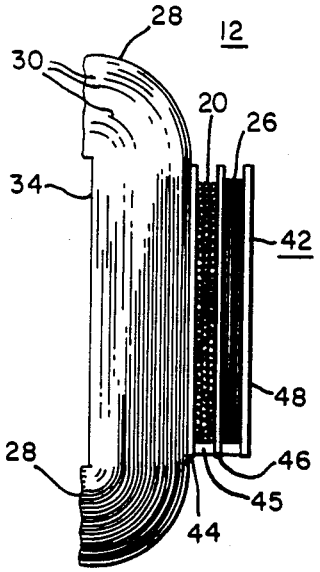
FIG. 4 is a cross-sectional view of the core-coil assembly shown in FIG. 3, taken between and in the direction of arrows IV—IV.

FIGS. 2 and 3 are plan and elevational views, respectively, of an exemplary form of the core-coil assembly 12 shown in FIG. 1, and FIG. 4 is a cross-sectional view of core-coil assembly 12 taken between and in the direction of arrows IV—IV. Core-coil assembly 12 includes a magnetic core 28 wnhich may be wound from a continuous elongated strip of magnetic material such as grain oriented electrical steel, or an amorphous alloy of steel, to provide a plurality of nested or superposed laminations 30. Transformer 10 may be of the single-phase, core-form type, as illustrated, or it may be of any other type, single or polyphase. In the example illustrated, the magnetic core 28 is a single loop shaped into a round cornered rectangular configuration having first and second spaced, parallel winding leg portions 32 and 34, respectively, and upper and lower yoke portions 36 and 38, respectively, all of which define an opening or core window 39. First and second separate coil assemblies 40 and 42 may be disposed in inductive relation with winding legs 32 and 34, respectively, with these coil assemblies or sections being electrically interconnected as showwn in FIG. 1, or via any other suitable interconnecting arrangement. For example, sections 18 and 20 of the high voltage winding 16 may be disposed on winding legs 32 and 34, respectively, with the high voltage winding 16 usually being formed of a relatively small diameter insulated electrically conductive wire, as shown in the cross-sectional view of FIG. 4. Since there is room through the core window 39 for a split-gear or toroidal type winding apparatus to wind the innermost winding on the core leg, the high voltage winding sections 18 and 20 are formed first by conventional toroidal winding techniques. As shown in FIG. 4, ground insulation 44 is disposed about winding leg 34, and the high voltage winding section 20 is then wound directly about the winding leg, providing a plurality of winding layers, with a plurality of conductor turns per layer, and layer insulation 45 disposed between adjacent layers. High-low insulation 46 is disposed about the high voltage winding section 20, and the low voltage winding section 26 is wound directly about this insulation. An outer wrap of electrical insulation 48 completes winding section 42. For optimum efficiency, physical size, and good regulation, the winding window 39 should be substantially completely filled with the electrical windings.

Thus, there is no room for utilizing conventional techniques for winding a conductor about a leg of an uncut magnetic core.

The low voltage winding section 26 is illustrated as being formed of electrically insulated strip or sheet conductor, having one turn per layer, and this is the preferred embodiment. However, the apparatus and method to be hereinafter disclosed may also be used to wind relatively heavy electrical conductors, commonly referred to as strap, in which case there will be more than one conductor turn per layer. The important criterion is sufficient self-strength in the conductor to be wound to enable it to be easily inserted through the core window, while maintaining its initial direction and position. Thus, the lead end of the conductor may be easily handled and accurately passed between material handling apparatus on opposite sides of the core window.

Figure 5:
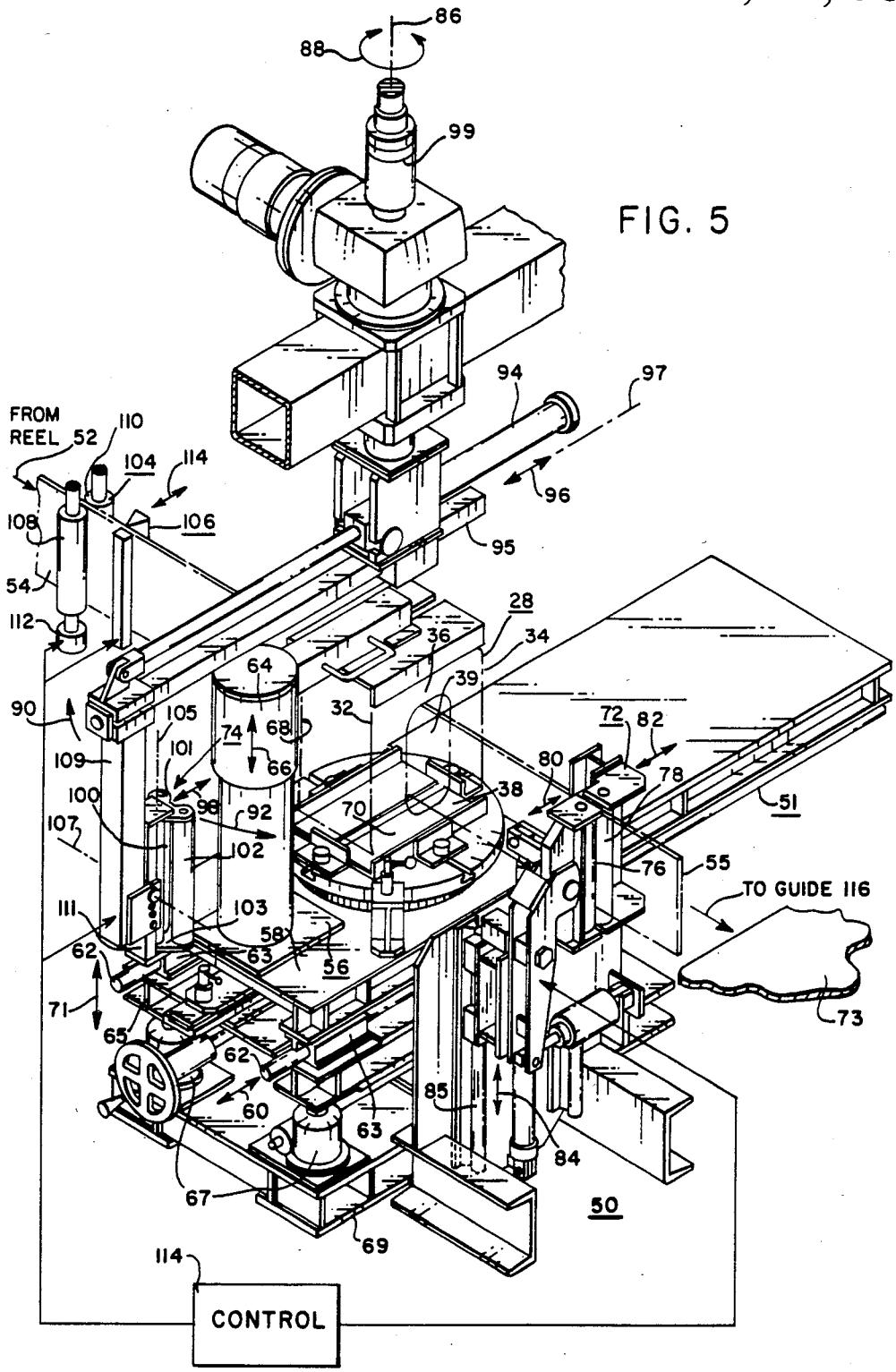
FIG. 5 is a perspective view of coil winding apparatus constructed according to the teachings of the invention.

FIG. 5 is a perspective view of coil winding apparatus 50 constructed according to the teachings of the invention. Coil winding apparatus 50 includes a conventional pay-off and brake (not shown) for holding a supply reel 52 (FIGS. 6–12) of electrical conductor 54. For purposes of example, it will be assumed that the electrical conductor 54 is in the form of insulated strip or sheet, such as aluminum or copper which has a thin coating of electrical insulation on one or both of its major surfaces. The end of conductors 54 which is initially inserted through the window 39 of magnetic core 28 will be referred to as the lead end 55, and when conductor 54 is severed, the remaining end of the resulting conductor will be referred to as the trailing or tail end 57.

Apparatus 50 further includes a core carriage 51 having a movable clamping fixture 56. Clamping fixture 56 includes a support table 58 which may be mounted for a rectilinear movement, illustrated by double-headed arrow 60. For example, table 58 may be mounted for movement via rails 62 and a plurality of ball bearing pillow blocks 63. Pillow blocks 63 may be supported on an elevating frame 65 which in turn may be supported by a base 69 via a jacking screw arrangement 67. Jacking screw arrangement provides a vertical adjustment for frame 65, which adjusts the vertical position of core 28 relative to a table top 73 located to support conductor 54. Double-headed arrow 71 indicates the vertical adjustment of frame 65. Magnetic core 28, shown in FIGS. 2–4, with high voltage winding sections 18 and 20 already wound into position on winding legs 32 and 34, respectively, is loaded on table 58, and it is clamped into the desired position by clamping arrangement 64, which is controllable in the directions of double-headed arrow 66.

Magnetic core 28, as positioned on table 58, has an entrance side 68 relative to core window 39, with the entrance side 68 facing the supply reel 52, and it has an exit side 70 facing table 73. The lead end 55 of conductor 54 always enters window 39 from the entrance side 68 of core 28, and it leaves the window from the exit side 70.

The entire coil winding process is performed by a single set 72 of pinch drive rolls disposed on the exit side 70 of core 28, and a single set 74 of ironing rolls, arranged to rotate about a selected winding leg of core 28, as well as to rotate about the entire core 28 in order to get into the next required position relative to a selected core leg.

Conductor 54 from supply reel 52 is directed through coil window 39, entering window 39 from the entrance side 68, and it is disposed between driven drive rollers 76 and 78 of the drive roll set 72. Drive rolls 76 and 78 are controllable between closed and open positions to respectively engage and disengage conductor 54, as illustrated by the double-headed arrows 80 and 82, and they are selectively drivable in forward and reverse directions to respectively advance and back-up conductor 54 as required. The set 72 of drive rolls is also mounted for vertical, rectilinear movement illustrated by double-headed arrow 84, such as being mounted for movement on guide rails 85. The set 72 of drive rolls is the only function of apparatus 50 which must be retracted rectilinearly during the coil winding process in order to prevent interference with the movement of conductor 54, which greatly simplifies apparatus 50.

The set 74 of ironing rolls is arranged for rotation about shaft 99 on rotational axis 86, as indicated by the curved double-headed arrow 88, and by arrows 90 and 92. The vertical axis of the winding leg of core 28 which is to have a winding disposed thereon is aligned with the vertical axis 86 at the time the magnetic core 28 is clamped to table 58. The diameter of the circle defined by the rotation of the ironing roll set 74 is selectively adjustable by a cylinder 94 which operates a horizontally oriented shaft 95 along its longitudinal axis 97, as indicated by double-headed arrow 96. The ironing roll set 74 is also radially movable in and out, as indicated by double-headed arrow 98, by virtue of its being mounted on a depending arm 109 which has its upper end fixed to movable shaft 95. Movement of the complete slide assembly, which includes shaft 95 and depending arm 109, enables the ironing roll set 74 to selectively press and release its rollers relative to the latest conductor turn, or turns, applied to the winding leg. Ironing roll set includes first and second spaced rollers 100 and 102 oriented for rotation about vertical axes. Iron rolls 100 and 102 are provided in different sizes, according to the different width of conductor 54 which may be wound. Rollers 100 and 102 and their supporting structure are designed to press conductor 54 tightly against a winding leg of magnetic core 28 while the ironing roll set 74 is rotating about axis 86. To provide the essential movement for achieving this function, the rollers 100 and 102 are mounted for rotation on the same upper and lower mounting plates 101 and 103, respectively. The upper and lower mounting plates 101 and 103 are in turn mounted for pivotal movement about a vertical axis 105, such as being provided by a vertically oriented plate member 111. Plate 111 is mounted for pivotal movement at the lower end of depending arm 109 on a horizontally oriented pivot axis 107.

After conductor 54 leaves supply reel 52, it may be passed through a set 104 of straightening rolls and a shear 106. The straightening roll set 104 includes first and second spaced rollers 108 and 110, respectively. A device 112 measures the length of conductor 54 from the lead end 55 to the shear 106. As illustrated, device 108 may be associated with the straightening roll set 104, and, for example, it may count the revolutions of one of the rollers, such as roller 108. The output of device 112 is fed to control 114 which stops the drive roll set 72 when the desired length of conductor has passed the shear 106. For example, control 114 may include a comparator which compares the count provided by device 112 with a preselected count, and when it equals the preselected count, the comparator outputs a signal which stops the drive roll set 72. Control 114 may also output a signal to activate the shear 106, or to alert an operator to manually actuate the shear 106, as desired. The operation of shear 106 is indicated by double-headed arrow 114.

Apparatus 50 is completed by an adjustable guide or skirt 116 which is shown in FIGS. 6 through 12. Skirt 116 includes an elongated sheet of material which has its major flat surfaces vertically oriented. While the material of skirt 116 may be metallic, in a preferred embodiment it is formed of non-metallic material, such as nylon sheet, which provides a low friction surface for guiding conductor 54. One end of the guide or skirt 116, such as end 118 is fixed at a point laterally adjacent to the drive roll set 72, and the skirt is formed into a large loop 119 which ends at a supply reel 120 deposed on a controlled payoff. The supply reel 120 of the skirt material is located adjacent to the supply reel 52 of the conductor 54. The size of the loop 119 is controlled during the coil winding process to accommodate the desired initial length of conductor 54, and to bring the lead end 55 of conductor 54 back to the entrance side 68 of core 28 to start the next conductor turn.

The functioning of apparatus 50, as well as the new and improved coil winding method, will now be described relative to FIGS. 6 through 12, which schematically illustrate apparatus 50 and the various steps of the coil winding method.

More specifically, a supply reel 52 of conductor 54 is loaded onto its associated payout apparatus, and the magnetic core 28 is loaded into its fixture 56. The brake on the payout is released and conductor 54 is threaded through the straightening rolls 104 and shear 106. Shear 106 may be actuated to trim the lead end of conductor 54, if needed, to create a straight chain leading edge 55. The drive roll set 72 is cycled to its non-retracted or operable position and the drive rolls are parted. Conductor 54 is threaded through the core window 39, from the entrance side 68 to the exit side 70, through the open pinch or drive rolls 76 and 78, and then the drive roll set 72 is cycled to the closed position. With the lead end 55 of conductor 54 at a precisely defined location, the distance count device 12 is set, and the conductor payoff is set to provide a predetermined drag.

Figure 6:
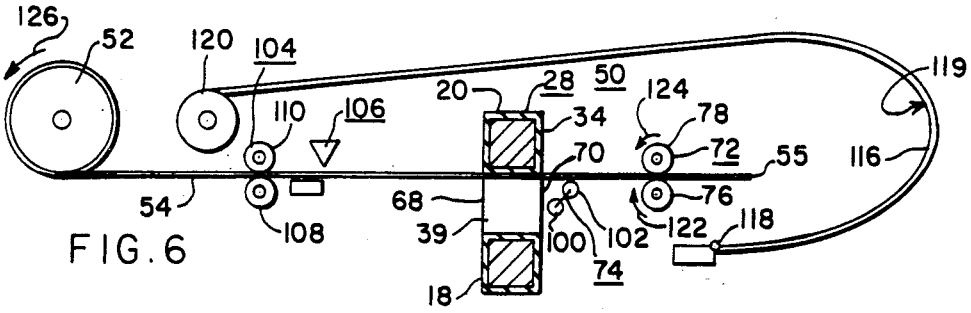
FIGS. 6 through 12 schematically illustrate steps in a new and improved method of winding an electrical conductor about the leg of a magnetic core.

The drive roll set 72 is then actuated to advance or drive conductor 54 forward onto support table 73, indicated by arrows 122 and 124 in FIG. 6, and it is automatically stopped when the desired length of conductor 54 has been paid out. Arrow 126 in FIG. 6 indicates rotation of supply reel 52 as the conductor 54 is pulled from the supply reel through the core window 39 by the drive roll set 72. Shear 106 is actuated, as indicated by arrow 128 in FIG. 7, after the drive roll set 72 stops, with the actuation of the shear being manual or automatic, as desired. When the conductor 54 is severed, a discrete conductor 154 is created having the desired length from the lead end 55 to the trailing end 57, as indicated in FIG. 8. The desired length of conductor 154 is the length necessary to create all of the conductor turns of the coil or part coil to be wound.

Figure 7:
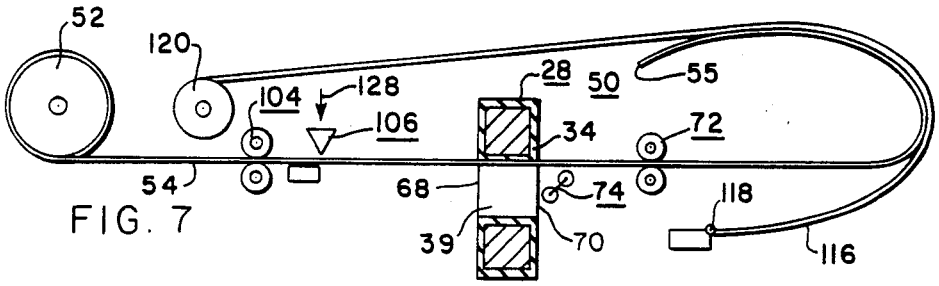
Figure 8:
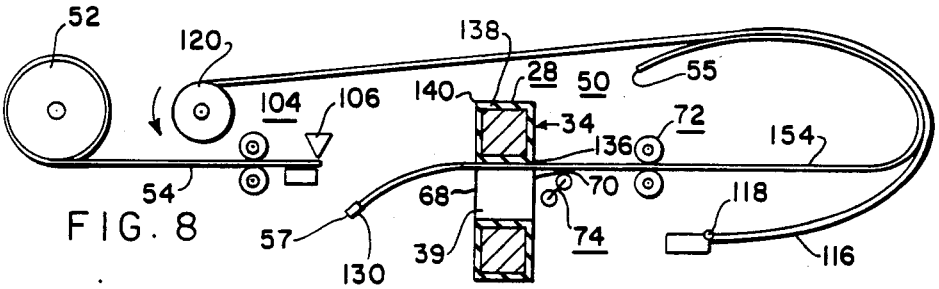

While the skirt 116 is illustrated as having the same size of loop 119 throughout the steps illustrated in FIGS. 6, 7 and 8, it would also be suitable to start with a small loop selected to immediately guide the lead end 55. The payout which holds supply reel 120 of skirt 116 would then be controlled to increase the size of loop 119 as the lead end 55 of conductor 154 advances.

After conductor 154 is severed by shear 106, an electrical terminal 130 is attached to the trailing end 57 of conductor 154. If more conductor length is required to get end 57 into the terminal applying device, such as a crimper, drive roll set 72 may be reversed. After terminal 130 is attached to end 57, the drive roll set 72 is set to advance the conductor 154 until terminal 130 can be easily positioned against an outer surface of core 28. While this outer surface will actually be part of winding 20, it will simply be hereinafter referred to as being a surface of the magnetic core 28. As illustrated, terminal 130 is preferably applied against surface 132 of winding leg 34 which defines the entrance side 68 of magnetic core 28. Terminal 130 is fixed to surface 132, such as via an insulative tape.

Figure 9:
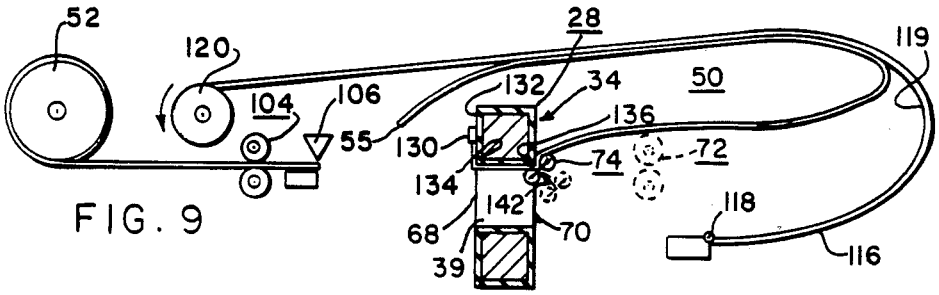

As illustrated in FIG. 8, coil leg 34 has four outer corners 134, 136, 138 and 140. Conductor 154 is shaped to conform tightly to corner 134 at the inlet side of core window 39. As illustrated in FIG. 9, the drive roll set 72 is opened and retracted at this point of the process and the conductor 154 is shaped to tightly conform to corner 136 at the outlet side of core window 39.

Figure 10:
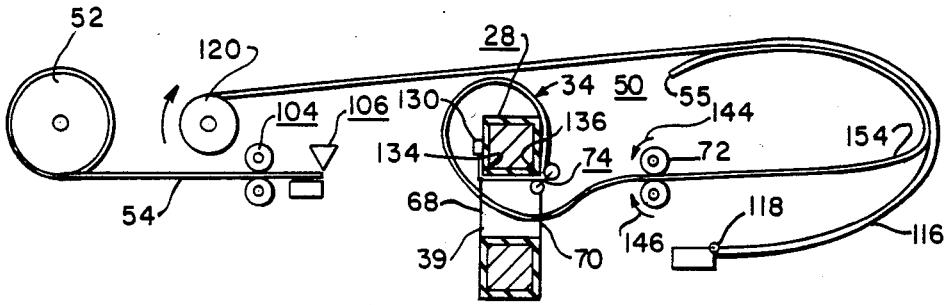

The ironing roll set 74 is then moved, as indicated by arrow 142 in FIG. 9, from the broken line position to a point adjacent to corner 136. Depending operating arm 109 is then cycled "in" to cause rollers 100 and 102 to straddle corner 136 and to apply pressure to conductor 154. This action now holds the tight corner fits of conductor 154, about corners 134 and 136. Skirt or guide 116 is now cycled "in", reducing the size of loop 119 to a smaller size, with the cycling being continued until the lead end 55 of conductor 154 is brought back to the entrance side 68 of magnetic core 28. It is to be understood that a robot may be dedicated to the job of bringing lead end 55 back to the proper starting position, but the disclosed guide loop arrangement is a low cost alternative when the apparatus 50 is not completely automated. The reduction in size of loop 119, along with the pressure applied to conductor 154 at corner 136 by ironing roll set 74, should swing conductor 154 out of the way of the retracted drive roll set 72. This will enable the drive roll set 72 to be extended, as shown in FIG. 10, enabling the lead end 55 of conductor 154 to be again inserted through the core window 39 from the entrance side 68. However, if the conductor 154 is not sufficiently out of the way of the drive roll set 72, it may be manually or automatically positioned. Once the lead end 55 of conductor 154 is redirected through the core window 39 from the entrance side 68, it will be directed through the "open" rollers of the drive roll set 72. Once conductor 154 is between the rollers 76 and 78 of the drive roll set 72, the rollers 76 and 78 are cycled to the "closed" position, and the power to the drive rolls is applied to advance conductor 154, as indicated by arrows 144 and 146 in FIG. 10. Guide or skirt 116 is cycled out to increase the size of loop 119, as the drive roll set 72 advances conductor 154.

Figure 11:
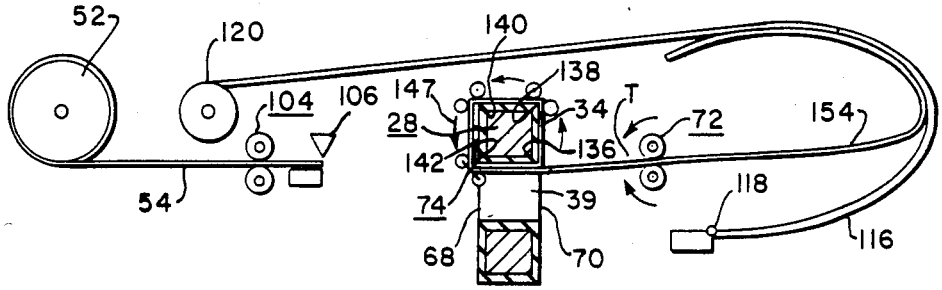

When the just-formed conductor turn about core leg 34 is taut, the ironing roll set is cycled forward, i.e., counterclockwise as viewed in FIG. 11 and indicated by arrow 147, traveling from corner 136, to corner 138, to corner 140, and then to corner 142 where it stops. The rotatable rolls 100 and 102, and the pivotable movement of the roll carriers 101 and 103 about axes 105 and 107, all enable the ironing roll set 74 to rotate about the axis 88 of core leg 34 while applying pressure against conductor 154. While the ironing roll set 74 is moving about the core leg 34, from corner 136 to corner 134, the drive roll set continues to apply tension T to conductor 154, advancing conductor 154 slightly as the "ironing" process continues to provide additional conductor length.

Figure 12:
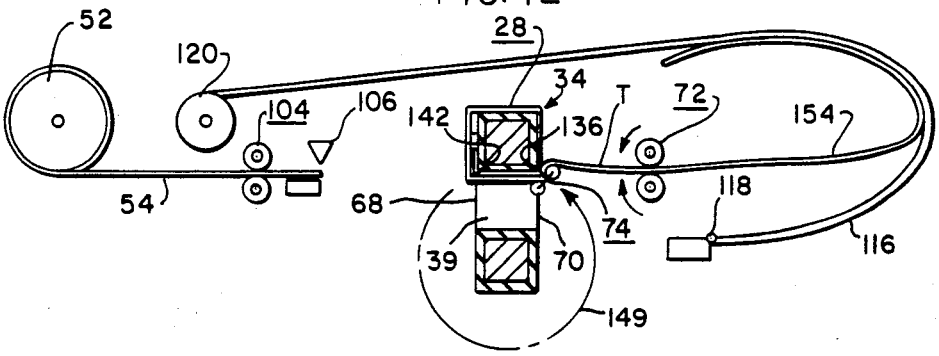

While continuing to maintain tension T in conductor 154 via the drive roll set 72, depending arm 109 associated with the ironing roll set 74 is cycled "out", to release the pressure on conductor 154, cylinder 94 is actuated to move the horizontally oriented arm 95 outwardly along its axis 97, until the ironing roll set 74 has room to clear the entire magnetic core 28 and its clamping fixture 56, and then the entire operating mechanism for the ironing roll set 74 is rotated counterclockwise about the axis 86 of shaft 99, as indicated by arrow 149 in FIG. 12. Once the ironing roll set 74 is properly circumferentially positioned, cylinder 94 is cycled "in" in place the ironing roll set immediately adjacent to corner 136, to press the ironing roll set 74 tightly against corner 136. This completes the formation of a conductor turn.

The drive pressure provided by the drive roll set 72 may now be released, since the ironing roll set 74 is holding the conductor 54, with the release of pressure being achieved by opening the drive rolls. The drive roll set 72 is then retracted, and the size of loop 119 is reduced to bring the lead end of 55 of conductor 54 back to the entrance side 68 of core 28, as shown in FIG. 9. The steps of FIGS. 10, 11 and 12 are then repeated to apply the next conductor turn to the core leg.

After the desired length of conductor 54 has been used to form the desired number of conductor turns, the lead end 55 is anchored to the core via insulating tape, and the core 28 is rotated to get it into position to wind a low voltage winding on the second leg. When both sections of the low voltage winding are completed, the core 28 is unloaded from its fixture. Another core is then immediately loaded into the fixture to start the same process on another magnetic core. The magnetic core just removed from the fixture will have its "finish" ends trimmed, and electrical terminals will be attached. The outer wrap 48 of insulation is then applied.

In summary, there has been disclosed new and improved coil winding apparatus and methods which enables sheet, strip or strap conductor to be wound directly in place about a winding leg of a magnetic core, without requiring anything but the conductor itself to be inserted through the core window. Thus, an excellent space factor within the core window may be easily achieved. The new apparatus and methods requires only a single set of drive rolls and only a single set of ironing rolls, with the two sets of rolls cooperating to wind conductor turns tightly about a core leg, with only the drive rollers retracting at a predetermined point in the winding process to prevent interference with the conductor. A low cost but effective guide loop automatically changes in size to accommodate the initial desired length of conductor, as well as the remaining length of the conductor after each conductor turn is applied, while reducing its size when required to bring the lead end of the conductor back to the entrance side of the core window to start the next conductor turn.

We claim as our invention:

1. Apparatus for winding an elongated, electrically conductive member through the window and about a leg of a magnetic core, for making a core-coil assembly, comprising:

means for dispensing an electrical conductor, a single set of drive rolls for selectively engaging and disengaging said conductor, control means, said drive rolls being positioned and operably controlled by said control means to engage said conductor, pull it through the window of the magnetic core from said dispensing means, and disengage, with the window having entrance and exit sides for the conductor, means for shearing the conductor to a desired length having lead and tail end portions, means for securing said tail end portion to a leg of the magnetic core, a single set of ironing rolls at the exit side of the core window for holding the conductor against the core leg, guide means for directing the lead end of the conductor in a loop, through the core window via its entrance side, for re-engagement with said drive roll means, and means for moving said ironing rolls about the core leg, from the exit side to the entrance side, while pressing the conductor against the core leg, said control means synchronizing said drive rolls and said ironing rolls, such that the drive rolls pull and tension the conductor as the ironing rolls move about the core leg, to tightly wrap the conductor about the core leg to form a conductor turn.

2. The apparatus of claim 1 wherein the guide means includes an elongated guide member in the shape of a loop, and including means for changing the size of the loop to direct the lead end of the conductor toward the entrance side of the core window.

3. The apparatus of claim 2 wherein the elongated guide member includes an upstanding strip of non-metallic material.

4. The apparatus of claim 1 wherein the single set of drive rolls is retractable, and the single set of ironing rolls is rotatable about the entire magnetic core, as well as about the leg of the magnetic core, with the control means synchronizing the drive rolls and ironing rolls such that the drive rolls maintain tension on the conductor following the formation of a conductor turn, while the ironing rolls release contact with the conductor and move about the magnetic core from its entrance side to its exit side, to re-establish contact with the conductor and hold the conductor while the drive rolls retract, enabling the conductor to encircle the core leg for the next conductor turn.

5. A method of winding an electrical conductor through the window and about the leg of the magnetic core for making a core-coil assembly, comprising the steps of:

providing an electrical conductor having a lead end, directing the lead end of the conductor through the window of the magnetic core from an entrance to an exit side thereof, advancing the conductor via a single set of drive rolls to provide a desired conductor length, shearing the conductor to said desired length to provide a tail end, securing the tail end of the conductor to the magnetic core, pressing the conductor tightly against the magnetic core with a single set of ironing rolls, adjacent to the exit side of the window, operating said single set of drive rolls to tension said conductor, and wrapping the conductor tightly against the magnetic core with said single set of ironing rolls, from the exit to the entrance side, while the conductor is being tensioned by said single set of drive rolls.

6. The method of claim 5 including the step of redirecting the lead end of the conductor through the entrance side of the window, and repeating the pressing, tensioning and wrapping steps, until said desired length of conductor is wound about the core leg.

7. The method of claim 5 including the step of releasing the ironing rolls from the conductor while maintaining tension therein via the single set of drive rolls, moving the ironing rolls to the exit side of the core, pressing the conductor against the exit side of the magnetic core via the single set of ironing rolls, disengaging the drive rolls from the conductor, retracting the drive rolls, redirecting the lead end of the conductor through the entrance side of the window, extending the drive rolls and re-engaging the conductor, and repeating the pressing, tensioning and wrapping steps until the desired length of conductor is wound about the core leg.

8. The method of claim 5 including the step of providing a looped guide member for guiding the conductor as it leaves the exit side of the core window, reducing the loop size of the guide member to direct the lead end of the conductor back to the entrance side of the core window, and repeating the directing, advancing, pressing, tensioning and wrapping steps to form another conductor turn.

* * * * *